US005842957A

United States Patent [19]

Wheeler

[11] Patent Number: 5,842,957

[45] Date of Patent: Dec. 1, 1998

[54] AQUATIC EXERCISE WEIGHT

[76] Inventor: Robert L. Wheeler, 823A E. Gulf Blvd., Indian Rocks Beach, Fla. 33785

[21] Appl. No.: 916,965

[22] Filed: Aug. 19, 1997

Related U.S. Application Data

[60] Provisional application No. 60/024,267 Aug. 21, 1996.

[51] Int. Cl.[6] ..... A63B 21/008; A63B 21/072

[52] U.S. Cl. ..... 482/111; 482/106

[58] Field of Search ..... 482/111, 106, 482/108, 107

[56] References Cited

U.S. PATENT DOCUMENTS

| | | | |
|---|---|---|---|
| 983,372 | 2/1911 | Johnson | 482/106 |
| 990,791 | 4/1911 | Whitley et al. | 482/106 |
| 4,103,887 | 8/1978 | Shoofler | 482/106 |
| 4,458,896 | 7/1984 | Solloway | 482/111 |
| 4,854,576 | 8/1989 | McWain | 482/106 |
| 5,203,753 | 4/1993 | Rothhammer | 482/111 |
| 5,266,069 | 11/1993 | Thorne | 482/111 |
| 5,531,657 | 7/1996 | Macedo | 482/111 |

*Primary Examiner*—Richard J. Apley
*Assistant Examiner*—William LaMarca
*Attorney, Agent, or Firm*—Ronald E. Smith

[57] ABSTRACT

An aquatic exercise device for use by an exerciser standing in a natural or man-made body of water. The device includes containers that fill with water when immersed and which have drainage openings formed in them so that they drain when lifted out of the body of water. The exercise device may include a single container that is lifted from the body of water by a pulley and cable mechanism, or it may include a single container connected to a rigid bar, mid-length of the bar, or it may be provided in the form of a barbell or a dumbbell having water containers at opposite ends of a rigid bar. In all embodiments, the flow rate of water draining from the container or containers may be adjusted to a flow rate selected by the exerciser. In the barbell, dumbbell, and central container embodiments, the containers are rotatably and eccentrically mounted with respect to an elongate or short or medium length bar, respectively, so that they invert when initially immersed and return to their repose position when lifted from the body of water, aligning the drain holes of the containers in their respective proper positions so that the containers drain at the same rate when lifted out of the water. The size, number and location of the fill and drainage openings may be varied. In all embodiments, the rigid bar is hollow and buoyant.

13 Claims, 3 Drawing Sheets

AQUATIC EXERCISE WEIGHT

This application claims the Benefit of provisional application No. 60/024,267, filed Aug. 21, 1996.

BACKGROUND OF THE INVENTION

1. Field of the Invention

This invention relates, generally, to weight-lifting equipment. More particularly, it relates to weight-lifting equipment adapted for use in bodies of water.

2. Description of the Prior Art

Conventional weight-lifting equipment includes dumbbells and barbells made of iron or other heavy material. Complex machines have also been developed to provide an even wider variety of weight-lifting exercises. All of these devices, however, are intended for use on dry land. Moreover, the weight being lifted remains constant throughout the duration of the exercise. As a result, weight lifters often drop or throw the weights down at the completion of a particularly strenuous exercise. Such practice is unsafe and can lead to serious injury. Moreover, such practice requires that the weight-lifting take place on special flooring.

Some inventors have developed exercise devices for use under water. For example, see U.S. Pat. No. 5,531,657 to Macedo and U.S. Pat. Nos. 4,311,306, 4,458,896 and 4,819,951 to Solloway. However, each of these devices is displaced under water so that the exerciser's muscles are strengthened by moving against the resistance of the water; none of these devices are lifted out of the water. Thus, they cannot be used like conventional weights in exercises such as overhead pressing, for example.

What is needed, then, are exercise devices that can be used in water in substantially the same way they would be used on dry land. However, the needed devices should be safe, i.e., they should remove the need for an exerciser to throw down a heavy weight at the completion of an exercise.

In view of the art considered as a whole at the time the present invention was made, it was not obvious to those of ordinary skill in this art how the needed improvements could be provided.

SUMMARY OF THE INVENTION

The longstanding but heretofore unfulfilled need for an apparatus that overcomes the limitations of the prior art is now met by a new, useful, and nonobvious invention. In a first embodiment, the present invention includes a rigid bar of predetermined extent and a container means including a first container rotatably attached to a first end of the rigid bar and a second container rotatably attached to a second end of the rigid bar. Suitable means are provided for eccentrically attaching the first and second containers to the first and second opposite ends, respectively, so that the containers assume their respective positions of equilibrium when in repose; the center of gravity of each container is below the rigid bar.

The novel stucture further includes a first aperture means formed in each of the containers for admitting water thereinto when the containers are immersed in a body of water and a second aperture means formed in each container for draining water therefrom when the containers are lifted from the body of water.

In this way, the containers are at least partially filled when immersed in a body of water for a predetermined period of time, and water in the containers is drained therefrom when the containers are lifted from the body of water so that the weight of the exercise device, upon being lifted from the water, diminishes over time.

Significantly, the weight of the novel device is at a maximum at the moment it is separated from the water surface so that maximum training benefits are achieved by the exerciser at the beginning of the weight-lifting procedure. The weight of the novel device is at a minimum after it has been held out of the water for a length of time sufficient to allow complete drainage of water from the containers. Thus, the exerciser can lower the device comfortably and safely. If the exerciser prefers to simply drop the device or throw it down after the containers have been emptied, no harm is done.

The means for eccentrically attaching each container to the rigid bar includes, in a first embodiment, an eccentric bore formed in each of the containers so that the rigid bar passes through the containers in parallel but offset relation to a centerline of the containers. Each of the eccentric bores has a diameter sufficient to rotatably receive the rigid bar therethrough. In a second embodiment, the eccentricity is achieved by hanging the containers from the rigid bar with a plurality of longitudinally-spaced apart clamps. In a third embodiment, the containers are provided in the form of open-topped buckets, i.e., the open top of the buckets performs the function of the water-admitting aperture of the first two embodiments.

Additional embodiments add features such as means for adjusting the drainage flow rate, including means for stopping all drainage if the exerciser desires the novel structure to emulate a conventional weight. Still further embodiments eschew the use of a rigid bar of the type found in barbells and dumbbells, and employ a pulley and cable apparatus instead for lifting a single container out of the water.

In the rigid bar embodiments, a travel limiting or barrier means for preventing linear travel of the containers along the extent of the rigid bar is provided.

It is a primary object of this invention to promote physical fitness by providing hollow exercise weights in the form of hollow containers that are adapted to readily fill with water when immersed in a body of water and to discharge water when lifted from said body of water so that an exerciser may allow all or any percentage of the water to drain out prior to lowering the device.

A related object is to provide a safety-promoting exercise device that avoids the shortcomings of prior art weight-lifting devices that require an exerciser to lower the same amount of weight that was lifted.

Still another object is to provide an aquatic exercise device that enables the exerciser to control the rate of drainage flow from the device across a wide range of flow rates, including no drainage flow at all when it is desired to simulate prior art exercise devices.

Another object is to enable an exerciser to control the weight of the device to be lifted by the simple expedient of controlling the amount of time the novel device is immersed or by not fully immersing the containers in the body of water.

Yet another object is to provide an easy-to-use aquatic exercise device that is economical to manufacture and thus affordable by consumers.

These and other important objects, features, and advantages of the invention will become apparent as this description proceeds.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
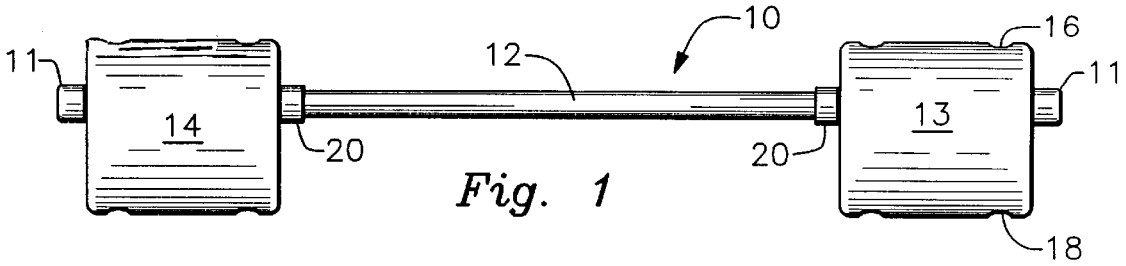
FIG. 1 is a front elevational view of a first embodiment of the invention when not immersed in water.

Referring now to FIG. 1, it will there be seen that a first exemplary embodiment of the invention is denoted as a whole by the reference numeral 10.

Barbell assembly 10 includes an elongate rigid bar 12, which is preferably hollow to enhance its buoyancy, and a pair of hollow container members, collectively denoted 14, mounted on said bar at its opposite ends. Imperforate caps 11 keep water out of the interior of bar 12; the floatability of bar 12 is a safety and a utilitarian feature.

In this first embodiment, each container 14 is impaled by elongate bar 12 at a point eccentric to the horizontal centerline of each container. Accordingly, when assembly 10 is held above water, containers 14 will hang from barbell 12 in their equilibrium or repose position as depicted, i.e., their center of gravity will be below rigid bar 12. The apertures formed in each container to admit rigid bar 12 thereinto have a diameter only slightly greater than the external diameter of bar 12 so that said containers are free to rotate with respect to bar 12. Rigid bar 12 may be of solid or hollow construction. Preferably, said rigid bar and the containers 14, 14 are formed of a high impact plastic.

The eccentric mounting of the containers ensures that the drain holes of both containers will be aligned with one another when device 10 is lifted clear of the water, thereby ensuring that both containers will drain at the same rate.

For reference purposes, the part of each container having the shortest radius from bar 12 to the periphery of the container will be referred to as the short side, and the part having the longest radius will be referred to as the long side. Thus, it can be said that in FIG. 1, the short side of each container is positioned above the long side thereof whether containers 14 are empty, partially filled, or completely filled with water, i.e., due to the rotatable, eccentric mounting of the containers to the rigid bar, they will hang freely as depicted when not immersed in water and will maintain said position when rigid bar 12 is rotated about its longitudinal axis during a weight-lifting procedure.

Figure 4:
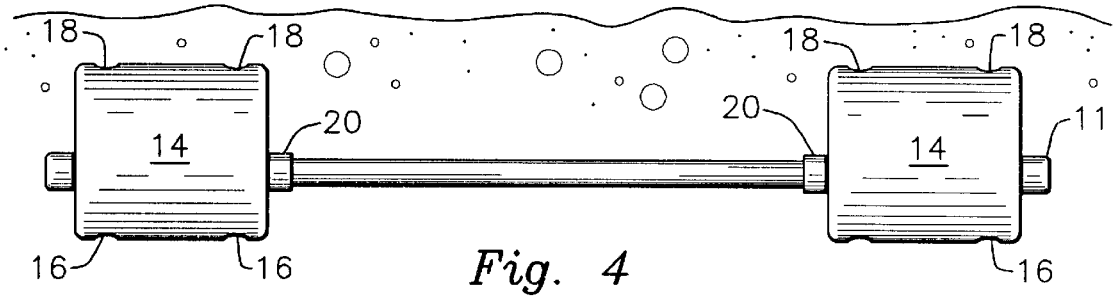
FIG. 4 is a front elevational view of the first embodiment of the invention when immersed in water.

A water-admitting or entrance aperture 16, 16 is formed in each container 14, 14 at a preselected location on its short side. At least one drain opening or exit aperture 18, 18 is formed in said containers on their respective long sides. When assembly 10 is immersed in water, air within containers 14 will cause the containers to invert from their respective FIG. 1 positions, as depicted in FIG. 4. This is because the long side thereof holds more air than the short side so the buoyancy of the long side is greater than the buoyancy of the short side when containers 14, 14 have been immersed. Water will thus enter each container 14, 14 through entrance apertures 16, 16 and air will exit through exit or drainage apertures 18, 18 in the form of bubbles.

Note that drainage apertures 18, 18 could be positioned on the inboard or outboard vertical sidewalls of containers 14, 14.

Advantageously, the exerciser can allow containers 14, 14 to be fully filled simply by waiting until the bubbles no longer exit from drainage apertures 18, 18; this provides maximum weight for any exercise that follows. Alternatively, the exerciser can hold containers 14, 14 under water for preselected periods of time less than the time required to allow filling of said containers. This will allow the exerciser to fill each container to any degree desired. A beginning exerciser might decide to hold the containers under water for just one second so that only a small percentage of the containers is filled. After becoming comfortable with that weight, the exerciser can hold the containers under water for two seconds to increase their weight, and so on until the exerciser is ready to work out with completely filled containers.

Alternatively, the exerciser can achieve partial filling simply by not submerging the containers completely, i.e., by only partially submerging entrance openings 14, 14.

There are many mechanical means that may be employed to prevent containers 14, 14 from sliding with respect to the length of elongate bar 12. For example, barriers 20, 20, which are hollow pipes having an internal diameter slightly less than the external diameter of rigid bar 12, may be press fit onto said bar 12 on opposite sides (inboard and outboard) of each container (with end caps 11 serving as the outboard barriers). Alternatively, where bar 12 is a hollow bar, it may be cut so that it terminates at the inboard end of a container, and a second or auxiliary rigid bar having an external diameter slightly greater than the internal diameter of bar 12 may be press fit thereinto so that it effectively extends the length of bar 12. A cap 11 is then placed on the outboard side of the container, it being understood that the shoulder formed by the reduction in diameter that occurs where the auxiliary rigid bar meets bar 12 serves as a barrier means for said inboard side of the container. In this particular design, the respective diameters of the bar-receiving apertures formed in the containers must be slightly greater than the external diameter of the auxiliary rigid bar, and less than the external diameter of bar 12.

Figure 2:
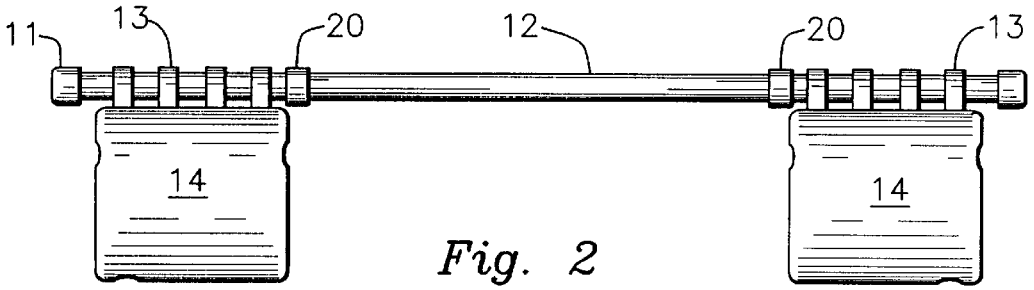
FIG. 2 is a front elevational view of a second embodiment when not immersed in water.

To avoid providing bar-receiving apertures in each container 14, 14, the containers may be suspendedly engaged to rigid bar 12 by a plurality of clamps, collectively denoted 13, that are longitudinally spaced apart along the length of bar 12 as depicted in FIG. 2. The containers will invert from their depicted position when immersed, for the same reason as provided in connection with the embodiment of FIG. 1.

Figure 3:
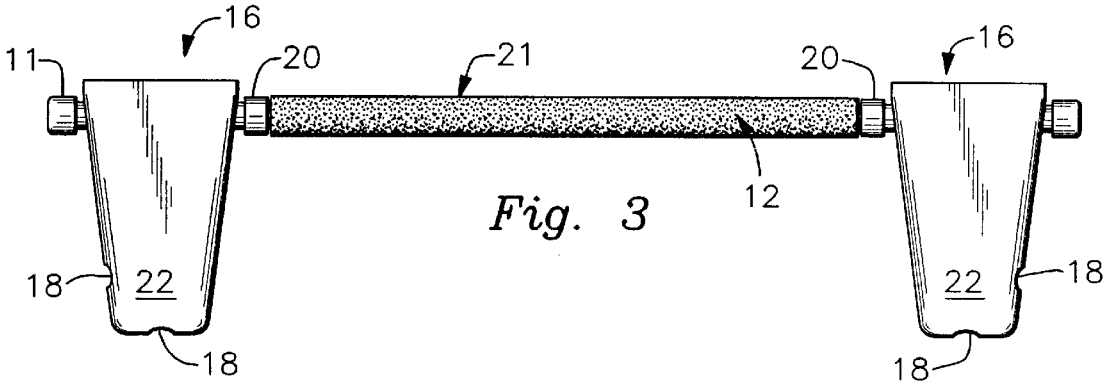
FIG. 3 is a front elevational view of a third embodiment when not immersed in water.

Containers 14, 14 may be provided in the form of open-topped buckets 22, 22, as depicted in FIG. 3. In this way, the open top of each bucket performs the function of water-admitting apertures 16, 16 in the first two embodiments.

Accordingly, this embodiment has the advantage of providing a very-rapidly fillable container. Buckets are also inexpensive to manufacture. Moreover, since the contents of the buckets are easily visible, this embodiment has the advantage of allowing the exerciser to visually ascertain the percentage of filling of the containers prior to beginning the lifting thereof from the water. The containers 14, 14 of the first two embodiments could be made of a clear material, such as an acrylic plastic, to enable visual inspection of their contents as well.

Reference numeral 21 in FIG. 3 denotes a foam covering for rigid bar 12 that further enhances its buoyancy and which provides greater comfort to the exerciser.

Figure 5B:
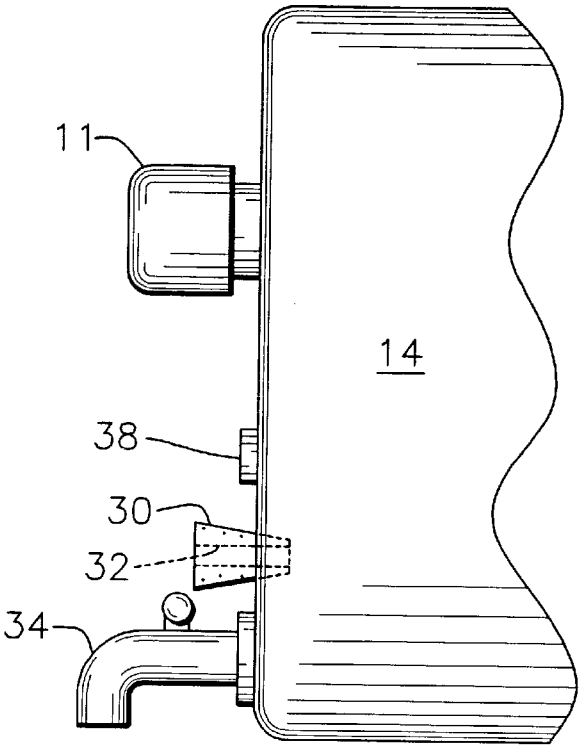
FIG. 5B is a side elevational view taken along line 5B—5B in FIG. 5A.
Figure 5A:
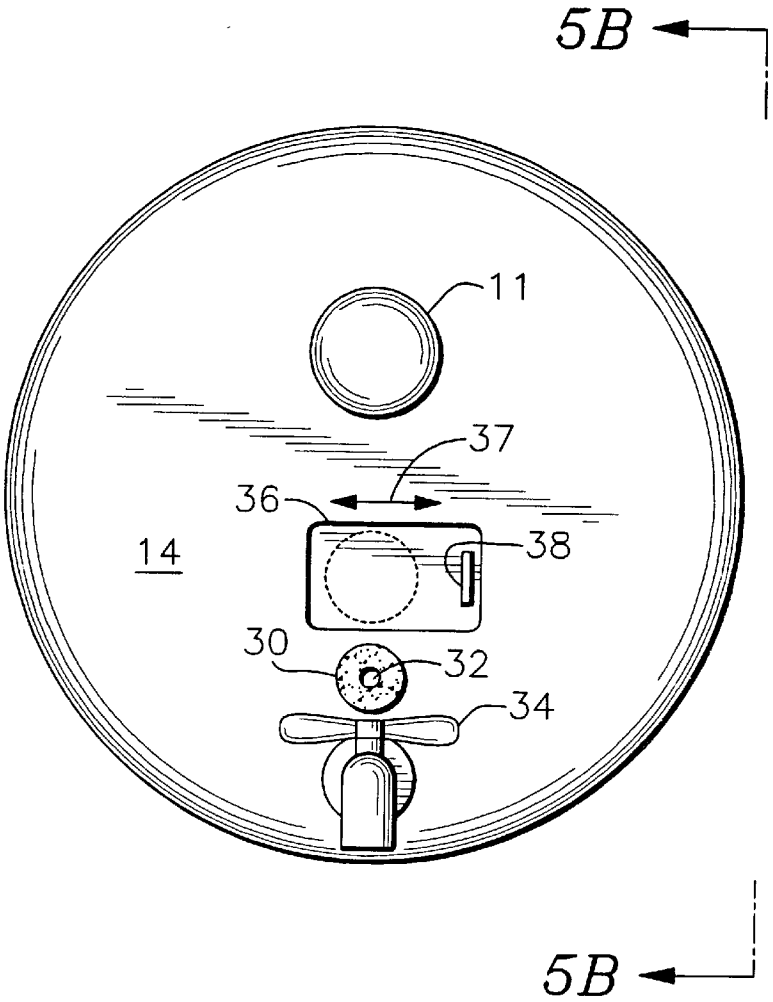
FIG. 5A is an end elevational view of the first embodiment.

Exit or drainage apertures 18, 18 may be provided in many different forms, as best understood in connection with FIGS. 5A and 5B. First of all, there may be only one exit aperture per container 14, 14 or bucket 22, 22, and said single exit aperture may be positioned on the bottom of the container or bucket or at any location on the side thereof. Secondly, there may be a plurality of exit apertures, including a single bottom aperture and a single side aperture, a single bottom aperture and a plurality of side apertures, a plurality of side apertures and no bottom aperture, and so on. Thirdly, each exit aperture may be plugged completely so that no water drains therefrom when the exerciser lifts the apparatus from the water; this configuration would be used when the exerciser wants maximum weight resistance for each exercise. Fourthly, at least one or all of the exit apertures may be provided with means for controlling the flow of water therefrom.

These alternatives are depicted in composite form in FIGS. 5A and 5B for explanatory purposes, it being understood that it would be unlikely to provide these differing types of flow restrictors in a single embodiment. In this particular example, the middle drain aperture is provided with a plug 30 in the form of a cork that has a drain aperture 32 formed in it. Use of such a plug would have the effect of providing a smaller drain aperture so that the water in containers 14, 14 would drain therefrom at a slower rate when the device 10 is lifted from the water. A plug not having a drain aperture formed therein would of course obviate the drainage hole entirely. The lowest drain aperture is provided with a valve means 34, here depicted in the form of a spigot, so that the rate of drainage could be restricted across a complete range including fully restricted and fully unrestricted. The uppermost drain aperture is provided with a sliding gate valve 36 having handle 38 so that it may be fully closed or opened to any degree desired by sliding said gate as indicated by double headed directional arrow 37. Numerous other valving means are within the scope of this invention.

It should be understood that elongate rigid bar 12 could also be provided in short form so that the barbell would become a dumbbell. In all other respects, dumbbells made in accordance with the teachings of this invention would be substantially the same as the barbells depicted herein.

Figure 6:
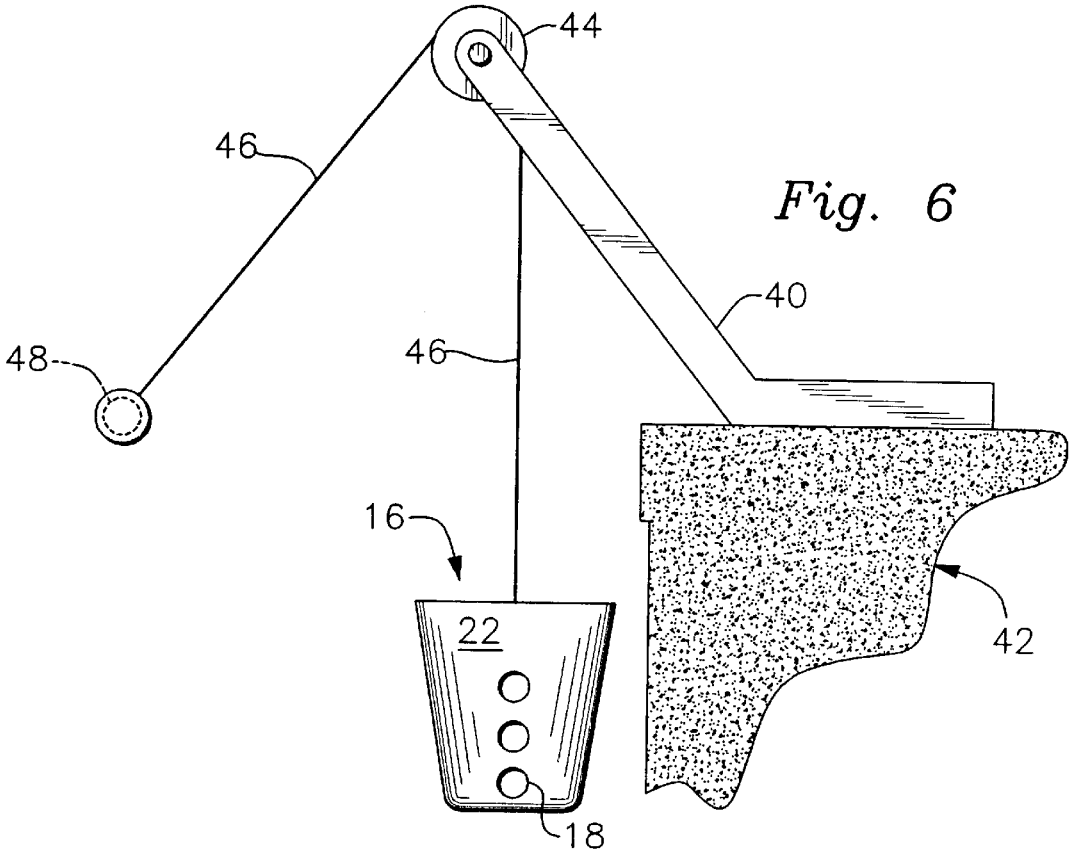
FIG. 6 is a side elevational view of a fourth embodiment.

It should also be understood that this invention is not restricted to barbells and dummbells; it can be adapted to provide numerous forms of weight-lifting devices. For example, the apparatus of FIG. 6 employs neither a barbell nor a dumbbell but is clearly within the scope of this invention. It includes a base member 40, mounted by suitable means to a swimming pool deck 42, for supporting a rotatably mounted pulley 44. An elongate, flexible cable 46 engages a container 14 or a bucket 22 and extends over the pulley; its free end terminates in a rigid linear-in-configuration handle 48 that is manipulated by an exerciser positioned in the swimming pool. The container or bucket may be provided with drainage holes 18 or adjustable flow rate drainage holes as in the earlier embodiments. In this way, an exercise is provided that exercises muscles other than those muscles exercised when using a barbell or a dummbell. Numerous other variations of such exercise devices are within the scope of this invention. If a container or bucket has means for admitting water when immersed and means for permitting drainage of said water when not immersed, then such device will infringe the claims that follow if incorporated into an exercise device used by exercisers standing in a body of water such as a swimming pool or a natural body of water such as a river, lake, gulf, ocean or the like.

Figure 7:
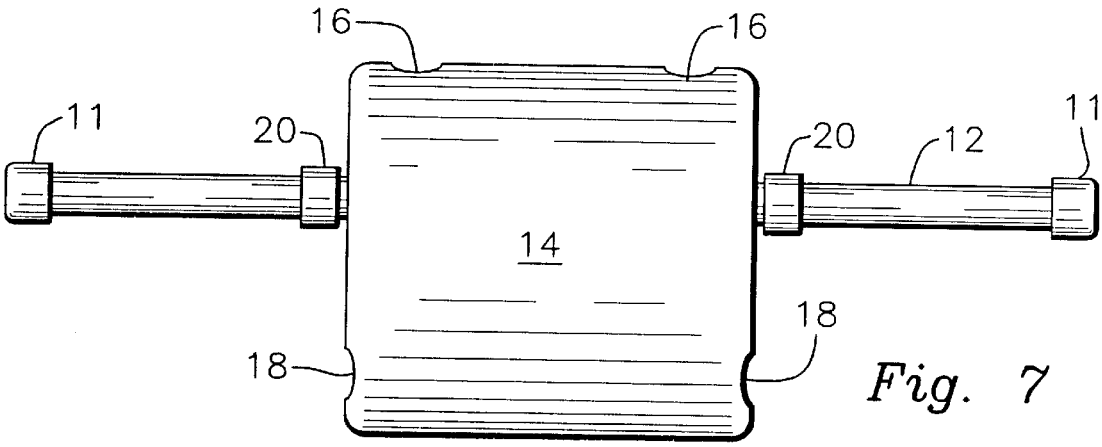
FIG. 7 is a side elevational view of a fifth embodiment.

A final illustative embodiment is depicted in FIG. 7. In this embodiment, a single weight member 14 is positioned mid-length of rigid bar 12 as depicted. Central weight member 14 may also be mounted in the manner depicted in FIG. 2. This provides a more compact exercise device compared to the devices depicted in FIGS. 1–4 in that the length of rigid bar 12 may be much shorter; this enables two or more people to exercise in a swimming pool at the same time without interfering with one another. Weight member 14 of the FIG. 7 embodiment is preferably larger and thus capable of holding more water than the weight members used in the embodiments having two of said weight members. Note that drainage apertures 18 are preferably positioned on the outboard vertical sidewalls of container 14, but they may be positioned in any desired functional location. The length of rigid bar 12 is between that of the barbell and dumbbell embodiments.

It will thus be seen that the objects set forth above, and those made apparent from the foregoing description, are efficiently attained and since certain changes may be made in the foregoing construction without departing from the scope of the invention, it is intended that all matters contained in the foregoing construction or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An exercise device, comprising:

a rigid bar of predetermined extent;

container means including a first hollow container rotatably attached to a first end of said rigid bar and a second hollow container rotatably attached to a second end of said rigid bar;

means for eccentrically attaching said first and second containers to said first and second opposite ends for rotation of said containers about said rigid bar, respectively;

a first aperture means formed on a first surface in each of said containers for admitting water thereinto when said containers are immersed in a body of water;

a second aperture means formed on a second surface opposite said first aperture in each container for draining water therefrom when said containers are lifted from said body of water;

whereby said containers are at least partially filled with water when said first aperture means is at least partially immersed in said body of water for a predetermined period of time; and whereby water in said containers is drained therefrom upon rotation of said containers about said rigid bar when said containers are lifted from said body of water so that the weight of said exercise device, upon being lifted from said body of water, diminishes over time so that an exerciser may safely lower the device.

2. The exercise device of claim 1, wherein said means for eccentrically attaching each container to said rigid bar includes an eccentric bore formed in each of said containers, each of said eccentric bores having a diameter sufficient to rotatably receive said rigid bar therethrough.

3. The exercise device of claim 2, further comprising travel limiting means for preventing linear travel of said containers along the extent of said rigid bar.

4. The exercise device of claim 3, wherein said travel limiting means includes a pair of barrier means positioned on said rigid bar on opposite ends of each of said containers.

5. The exercise device of claim 4, wherein each barrier means of said pair of barrier means is a hollow tubular member having an internal diameter slightly less than an external diameter of said rigid bar so that said hollow tubular members are snugly received by said rigid bar and frictionally retained thereon in non-slip relation thereto.

6. The exercise device of claim 3, wherein said travel limiting means includes an inboard barrier means and an outboard barrier means, said outboard barrier means being a hollow tubular member having an internal diameter slightly less than an external diameter of said rigid bar so that said hollow tubular member is snugly received by said rigid bar and frictionally retained thereon in non-slip relation thereto, and wherein said inboard barrier means is formed by an annular shoulder formed in said rigid bar, said annular shoulder defined by an auxiliary rigid bar of reduced diameter relative to a diameter of said rigid bar, said rigid bar being hollow and said auxiliary rigid bar having a diameter slightly greater than an internal diameter of said hollow rigid bar so that said auxiliary rigid bar is snugly received therein in non-slip relation thereto, said through aperture formed in said container having a diameter slightly greater than an external diameter of said auxiliary rigid bar so that said container is rotatably mounted with respect to said auxiliary rigid bar.

7. The exercise device of claim 1, wherein said means for eccentrically attaching each container to said rigid bar includes a plurality of clamps spaced along an extent of said rigid bar, each of said containers depending from said clamps.

8. The exercise device of claim 1, further comprising adjusting means for adjusting a flow rate of water draining from said second aperture means.

9. The exercise device of claim 8, wherein said adjusting means includes a plug member having a throughbore formed therein, said plug member having an external diameter slightly greater than an internal diameter of said second aperture means so that said plug member is frictionally engaged by said second aperture means and said throughbore being sized to allow a reduced rate of flow of water draining from said container relative to a rate of flow draining from said container through said second aperture means.

10. The exercise device of claim 8, wherein said adjusting means includes an adjustable valve means so that a drainage flow rate from said second aperture means can be adjusted from fully closed to fully open so that an exerciser may select any desired drainage flow rate.

11. The exercise device of claim 10, wherein said adjustable valve means is a spigot.

12. The exercise device of claim 11, wherein said adjustable valve means is a sliding gate valve.

13. The exercise device of claim 1, wherein said containers are open-topped buckets so that said first aperture means is provided in the form of said open top of said open-topped buckets.

* * * * *